United States Patent [19]

Russell et al.

[11] 4,346,896

[45] Aug. 31, 1982

[54] PORTABLE GOLF PRACTICE MAT

[75] Inventors: Leonard V. Russell, Cobham; Derek N. Beaney, Woking, both of England

[73] Assignee: Universal Materials Company Limited, Middlesex, England

[21] Appl. No.: 232,373

[22] Filed: Feb. 6, 1981

[30] Foreign Application Priority Data

Feb. 8, 1980 [GB] United Kingdom ..... 8004322

[51] Int. Cl.[3] ..... A63B 69/36

[52] U.S. Cl. ..... 273/195 A; 273/195 B

[58] Field of Search ..... 273/195 R, 195 A, 195 B, 273/187 R, 196, 197 R, 197 A, 198, 183 A

[56] References Cited

U.S. PATENT DOCUMENTS 3,107,920 10/1963 Strunk ..... 273/195 A X 3,936,055 2/1976 Scott ..... 273/195 B X

FOREIGN PATENT DOCUMENTS 1063586 3/1967 United Kingdom ..... 273/187 R

*Primary Examiner*—George J. Marlo

*Attorney, Agent, or Firm*—Toren, McGeady & Stanger

[57] ABSTRACT

A golf practice mat is made up of two frames hinged together with one frame having an area where a golfer can stand to hold the mat to the ground, and the other frame has two playing surface regions on which balls to be struck can be played. One of the regions has a simulated grass-type surface, and the other region is formed of strips of rubber or rubber based material in an open weave pattern which can receive and support a tee without damaging the material. Bars or struts are located within the frames and provide support for the area where the golfer can stand and for the playing surface regions. The playing surface regions are movably supported in the other frame.

6 Claims, 3 Drawing Figures

PORTABLE GOLF PRACTICE MAT

This invention relates to a portable golf practice mat.

Golf practice mats are used by golfers attempting to improve their playing technique, and the mat is used to simulate the surface of a golf course and to avoid damage to the ground or to the club when practising away from a golf course. Many golfers practise at home. If they hit balls from a grass lawn, there is the risk that the lawn may be damaged if the ball is not struck quite correctly. When playing on a concrete surface, there is a risk of damage to the club head.

According to the invention, there is provided a portable golf practice mat having a first area where the golfer can stand to stabilize the mat during use, and a second area where the ball to be struck can be placed, the second area being divided into a first region with turf or a simulated turf surface, and a second region adapted to receive a tee on which a ball to be struck can be placed, the mat being formed from two framed sections hinged together.

Preferably, the second area can be moved towards and away from the first area so that the mat can be used by people of different heights, and for practising with different clubs.

The simulated turf surface may be one of the many known simulated grass materials. The region adapted to receive a tee is preferably woven rubber fibre matting of the type used on winter tees on golf courses, which consists of an open pattern of matting formed from strips and washers and with an opening size sufficient to receive and grip a tee without damaging the matting itself.

The first area on which a golfer can stand can also be formed from this same type of matting, but with a more open pattern to reduce weight.

The first area can be formed on one of the framed sections, and the second area on the other of the framed sections. The framed sections can be folded together so that they lie flat against one another, or can be opened out so that they lie in one common plane.

The invention will now be further described, by way of example, with reference to the accompanying drawings, in which.

Figure 1:
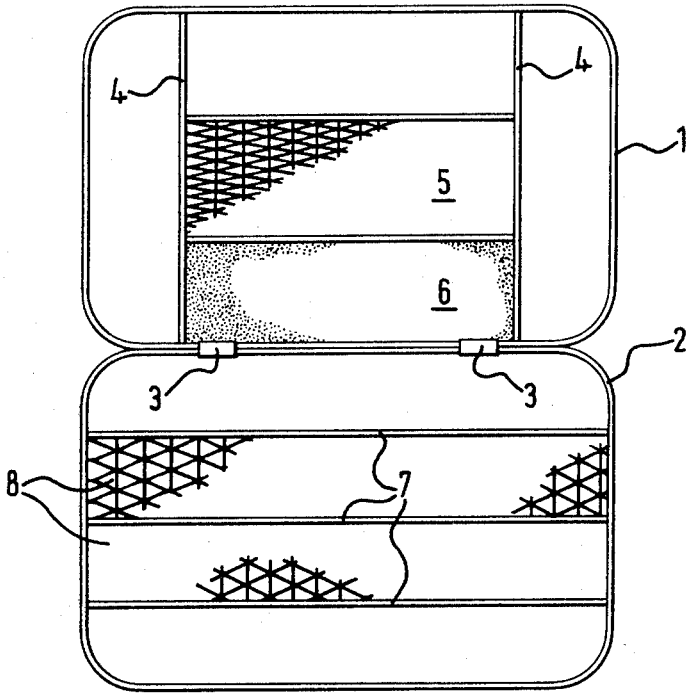
FIG. 1 shows a practice mat according to the invention ready for use.

The mat shown in FIG. 1 has a first frame 1 and a second frame 2. These frames are conveniently made out of aluminium tubing, for lightness. The two frames are connected by two hinges 3 which will be described in more detail with reference to FIG. 3.

Within the frame 1, there are two struts 4 connecting opposite long sides of the frame. These struts 4 support two playing surface regions 5 and 6. The regions 5 and 6 are mounted on the struts 4 so that they can be slid along the length of the struts. The region 5 will be made of close weave matting with the holes between adjacent strips being of a size suitable for receiving and gripping a tee peg. The region 6 will be of a simulated turf material. Alternatively, the regions 5, 6 may be supported on cross bars connecting opposite short sides of the frame 1.

The frame 2 has cross bars 7 connecting two opposite short sides of the frame 2. Matting 8 is provided between these cross bars, for the golfer to stand on. The matting will not be damaged by spiked golf shoes, and likewise will not cause any damage to such shoes. The matting 8 will be of the same nature as the matting in region 5, but can be of a more open weave since it does not have to grip a tee peg. The more open weave also reduces the weight. The cross bars 7 are constructed so that they resist bowing in a vertical direction when the device is placed on the ground and a golfer stands on the matting 8. This is to ensure that as large an area as possible of the frame 2 is held firmly in contact with the ground when a golfer stands on the matting to stabilize the mat.

The hinges 3 must resist relative movement along the hinge axis. Substantial forces will arise in this direction if, in use, a golf club strikes one of the regions 5 or 6 before making contact with the ball which is to be struck. The struts 4 must also be constructed in such a way that they are able to withstand forces of this nature.

The regions 5 and 6 which can be moved towards and away from the golfer standing on the matting 8 are arranged so that the matting region 5 is always further away from the golfer than the grass region 6. This is because a golfer may wish to practise with shorter clubs on the simulated grass surface, and with the longer clubs on the surface which can accept a tee.

Figure 2:
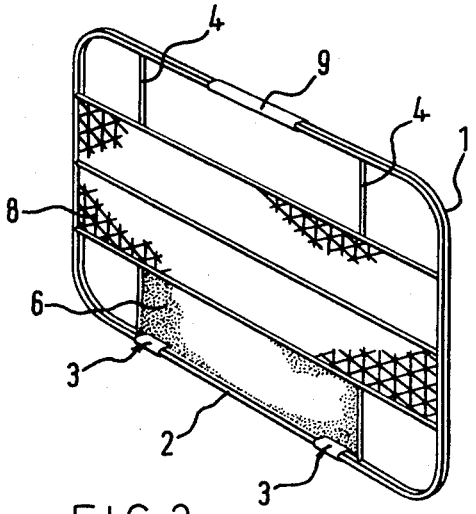
FIG. 2 shows the mat of FIG. 1 folded up for transport.
Figure 4:
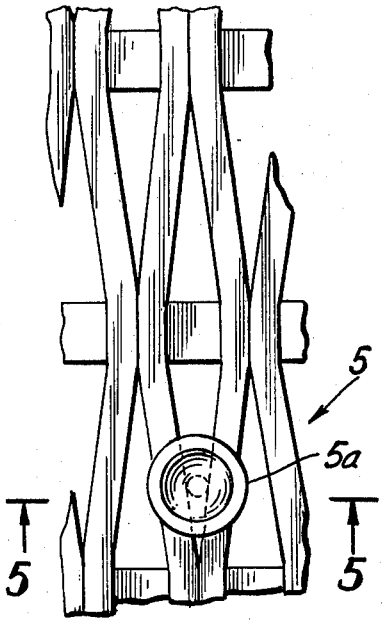
Figure 7:
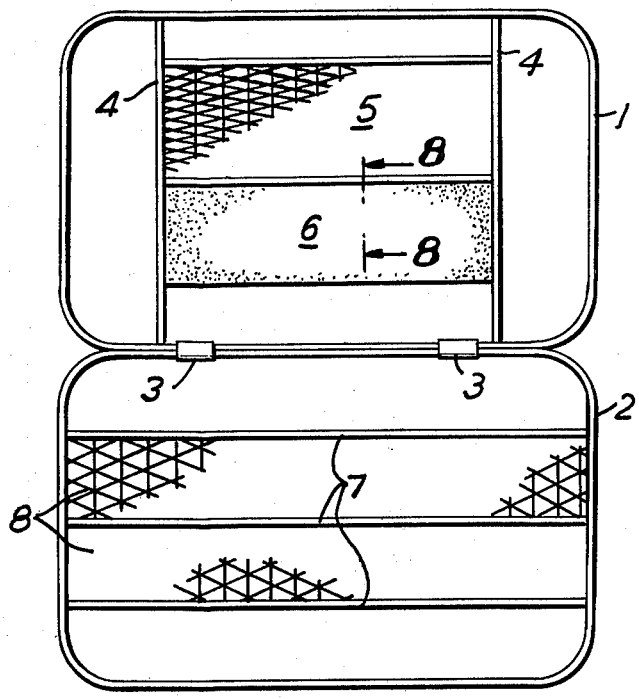
Figure 5:
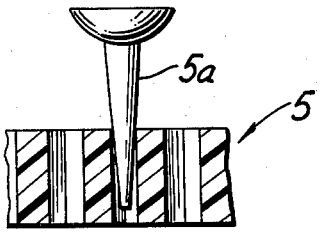
Figure 8:
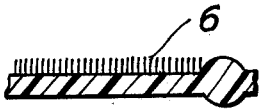
Figure 6:
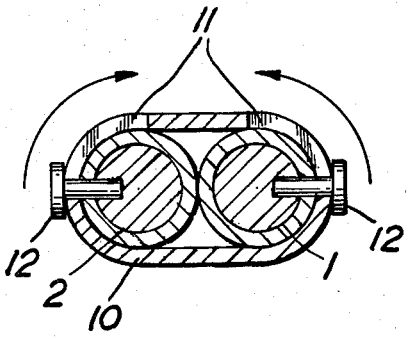

The two frames 1, 2 can be folded together as shown in FIG. 2 for transport. The mat can then be lifted by the frames themselves at the side opposite the hinge, and therefore there is no necessity for any device to lock the two halves of the frame together for transport. As shown in FIG. 2, the two frames each have a plastics sleeve 9 around the handle area.

Figure 3:
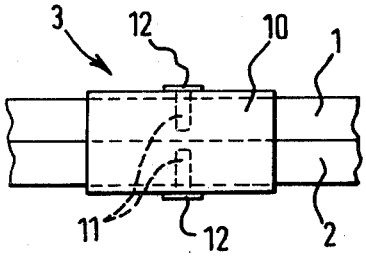
FIG. 3 is a detail of the hinge joining two frame sections.

Referring now to FIG. 3, it will be seen that the hinges 3 comprise a sleeve of flattened tubing 10 which surrounds the tubes of both frames 1 and 2. The sleeve 10 will be oval, as seen in cross section, and will be of a size such as only to permit the frame tubes to move angularly relative to each other. The sleeve 10 has slots 11 in it, and each frame tube has a lug 12 with a head fitted in it. The lugs 12 slide in the slots 11 to prevent relative longitudinal movement between the tubes of the frames 1 and 2. Although rubber strips may be used to joined the region 5, strips of other rubber-based materials may be used. Such materials may be purpose made for the application and can be with or without internal reinforcement.

As mentioned hereinbefore, the regions 5, 6 may be supported on bars connecting opposite short sides of the frame 1. If during a practice shot the head of the golf club strikes the region 5 or 6, the forces thus produced are transmitted directly to the relatively rigid frame 1, so that the stability of the mat is improved. The short sides of the frames may have formed therein a plurality of holes for receiving the bars, so that the positions of the regions 5, 6 can be preset and adjusted in discrete steps as desired,

We claim:

1. A portable golf practice mat comprising two frames, means hinging said frames together and forming a hinge axis, first means secured within one of said frames and defining a first area arranged such that a golfer can stand thereon so as to stabilize said mat during use, and second means secured within the order of said frames and defining a second area forming at least one playing surface wherein a golf ball can be placed, said second means including a first playing surface region and a second playing surface region, said first playing surface region comprising one of turf and simulated turf, and said second playing surface region arranged to hold a tee in a playing position so that a golf ball can be placed on the tee and driven from the tee.

2. A mat as set forth in claim 1, wherein said second means includes means for movably supporting said first and second playing surface regions so that said first and second playing surface regions are movable towards and away from said first area.

3. A mat as set forth in claim 1, wherein said second playing surface region arranged to hold a tee comprises matting formed of fibre rubber strips arranged in an open weave pattern defining openings sufficient in size to receive and grip the tee without damaging said mat.

4. A mat as set forth in claim 3, wherein said first area comprises matting formed of strips arranged in an open weave pattern defining openings which are larger than the openings defined by said matting of said second playing surface region.

5. A mat as set forth in claim 1, wherein said second means including at least two bars connected to opposite sides of said other of said frames and said bars extend parallel to the axis of said hinge means.

6. A mat as set forth in claim 5, wherein the opposite sides of the other of said frames are arranged to movably mount said at least two bars so that said bars can be positioned at different distances from said hinge axis, whereby the positions of said first and second areas are adjustable.

* * * * *